US005728448A

United States Patent [19]

Okeya et al.

[11] Patent Number: 5,728,448

[45] Date of Patent: Mar. 17, 1998

[54] REFLECTIVE WARP-KNIT TAPE

[75] Inventors: Sadaji Okeya; Syuji Wakata, both of Toyama-ken, Japan

[73] Assignee: YKK Corporation, Tokyo, Japan

[21] Appl. No.: 807,588

[22] Filed: Feb. 27, 1997

[30] Foreign Application Priority Data

Feb. 29, 1996 [JP] Japan ..... 8-043409

[51] Int. Cl.[6] ..... D04B 21/14

[52] U.S. Cl. ..... 428/193; 24/413; 66/192; 66/193; 66/202; 442/305; 442/314

[58] Field of Search ..... 24/413; 66/192, 66/193, 202; 442/305, 314; 428/193

[56] References Cited

U.S. PATENT DOCUMENTS 3,864,946 2/1975 Matsuda .
4,067,208 1/1978 Heimberger .
4,632,863 12/1986 Henningsson ..... 66/192

FOREIGN PATENT DOCUMENTS 0 109 951 5/1984 European Pat. Off. .
0 299 500 1/1989 European Pat. Off. .
0 399 708 11/1990 European Pat. Off. .
0 688 513 12/1995 European Pat. Off. .
2 625 017 6/1989 France .
1 370 634 10/1974 United Kingdom .

*Primary Examiner*—James C. Cannon
*Attorney, Agent, or Firm*—Hill, Steadman & Simpson

[57] ABSTRACT

In a reflective warp-knit tape, a narrow-width warp-knit tape is knitted of chain-stitch yarns, which form loops along longitudinal wales of the warp-knit tape, and weft inlaid yarns. And a reflective film is knitted in the warp-knit tape at a selected interwale space by the weft inlaid yarns and additional weft inlaid yarns. A heat-melting film also is knitted in the warp-knit tape at another selected interwale space by the weft inlaid yarns. Alternatively, the heat-melting film may be substituted by heat-melting yarns inlaid in the wales. In another alternative form, all the knitting yarns of the warp-knit tape may be thermoplastic resin monofilament yarns so that the light-reflecting function of the tape can be improved.

6 Claims, 5 Drawing Sheets

REFLECTIVE WARP-KNIT TAPE

BACKGROUND OF THE INVENTION

1. Field of the Invention

This invention relates to a narrow-width warp-knit tape in which a light-reflective film is knitted at a selected tape portion to reflect emitted light in the night so that the existence of the tape can be readily recognized, and more particularly to a reflective warp-knit tape for use on the waist, sleeve or collar of a garment, the edge of an umbrella, etc. or applied as a slide fastener tape.

2. Description of the Related Art

Japanese Utility Model Laid-Open Publication No. Sho 63-135390 discloses a slide fastener tape with a reflective sheet mounted on a part of a front surface of the tape. Japanese Utility Model Publication No. Hei 7-16606 discloses a traffic safety sign strip, which is in the form of a surface fastener with a reflective tape attached to its central portion, for use on a uniform for working in a road under construction.

In the slide fastener tape of the first-named publication, since the reflective sheet is attached to the front surface of the fastener tape by adhesive means, there is a fear that the reflective sheet might be removed off the fastener tape during use, thus its application is quite limited.

In the safety sign strip of the second-named publication, since the reflective tape is attached centrally to the front surface of the woven or knit surface fastener, the reflective tape tends to be easily removed off the surface fastener during use. Further, since a substrate sheet of this safety sign strip is a surface fastener, this safety sign strip is lacking in flexibility and is hence restricted by the term of use, as the range of applications is limited.

SUMMARY OF THE INVENTION

It is therefore an first object of this invention to provide a reflective warp-knit tape in which a reflective film comes out clearly on the front surface of the tape and is free from being removed off the tape even in a long-term use which is thin and hence adequately flexible so that the range of applications can be expanded.

A second object of the invention is to provide a reflective warp-knit tape in which a reflective film is knitted in a narrow-width warp-knit tape effectively and reliably by a unique knit structure, making the reflective warp-knit tape adequately tough.

A third object of the invention is to provide a reflective warp-knit tape in which a narrow-width warp-knit tape is adequately thin and flexible by specifying knitting yarns, thus enabling a reflective film to work effectively.

A fourth object of the invention is to provide a reflective warp-knit tape having a reflective film, which can be attached or mounted simply and easily on various kinds of goods.

A fifth object of the invention is to provide a reflective warp-knit tape having a reflective film, which is easy to knit and which can be attached or mounted simply and easily on various kinds of goods.

A sixth object of the invention is to provide a reflective warp-knit tape which in which a narrow-width warp-knit tape having a reflective film is transparent to enable the reflective warp-knit tape to be attached to various products directly so as to realize increased efficiency.

According to a first aspect of the invention, the first object is accomplished by a reflective warp-knit tape comprising: a narrow-width warp-knit tape having a plurality of longitudinal wales; and a reflective film knitted in the narrow-width warp-knit tape at a selected interwale space.

The second object is accomplished by a reflective warp-knit tape according to a second aspect of the invention, in which the narrow-width warp-knit tape is knitted of a first set of knitting yarns forming loops in the wales such as chain-stitch yarns, tricot yarns, two-needle-stitch yarns and single-cord-stitch yarns, and a second set of knitting yarns extending between the wales such as the above-named knitting yarns and weft inlaid yarns across the reflective film, interwale spaces where the reflective film are knitted in are knitted with the knitting yarns extending over and under the reflective film.

The third object is accomplished by a reflective warp-knit tape according to a third aspect of the invention, in which the narrow-width warp-knit tape is knitted of chain-stitch yarns and weft inlaid yarns, in order to make the tape thin and flexible.

The fourth object is accomplished by a reflective warp-knit tape according to a fourth object of the invention, in which the reflective warp-knit tape further includes a heat-melting film of thermoplastic resin having a melting point lower than that of the knitting yarns of the narrow-width warp-knit tape, which is knitted in the narrow-width warp-knit tape at interwale space along each of opposite longitudinal margins, in order to facilitate attachment of the narrow-width warp-knit tape to the product.

The fifth object is accomplished alternatively by a reflective warp-knit tape according to a fifth aspect of the invention, in which the reflective warp-knit tape further includes a heat-melting monofilament yarn of thermoplastic resin having a melting point lower than that of the knitting yarns of the narrow-width warp-knit tape, which is knitted in the narrow-width warp-knit tape in the wales along opposite longitudinal margins, in order to facilitate attachment of the narrow-width warp-knit tape to the product.

The sixth object is accomplished by a reflective warp-knit tape according to a sixth aspect of the invention, in which the knitting yarns of the narrow-width warp-knit tape are transparent thermoplastic resin monofilament yarns such as polyamide and polyester.

DETAILED DESCRIPTION OF THE PREFERRED EMBODIMENTS

Preferred embodiments of a reflective warp-knit tape of this invention will now be described in detail with reference to the accompanying drawings.

Figure 1:
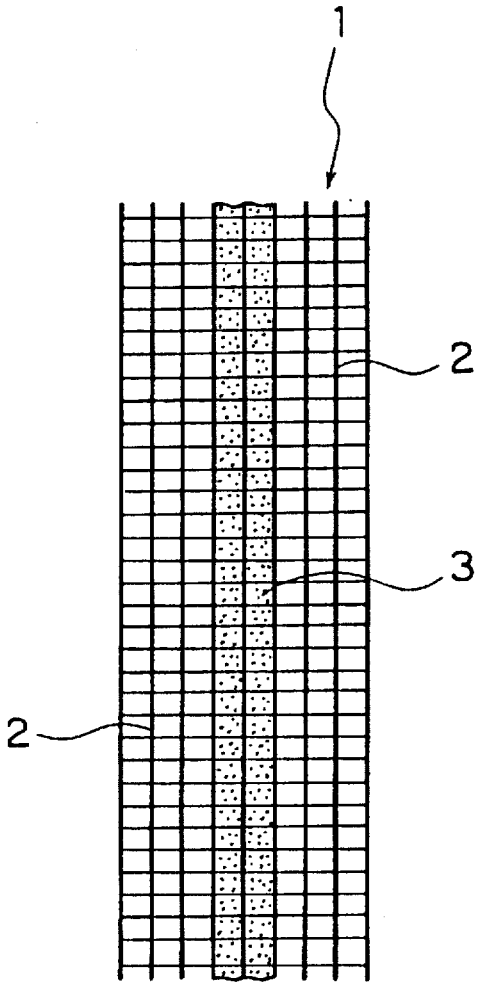
FIG. 1 is a plan view of a reflective warp-knit tape of the invention.

In the reflective warp-knit tape according to a first embodiment of this invention, as shown in FIG. 1, two reflective films 3 are knitted in a narrow-width warp-knit tape 1 respectively in and along two interwale spaces between three central wales 2. The narrow-width warp-knit tape 1 are knitted of monofilament yarns of synthetic fiber such as polyamide and polyester. Alternatively, the narrow-width warp-knit tape 1 may be knitted of multifilament yarns.

Figure 2:
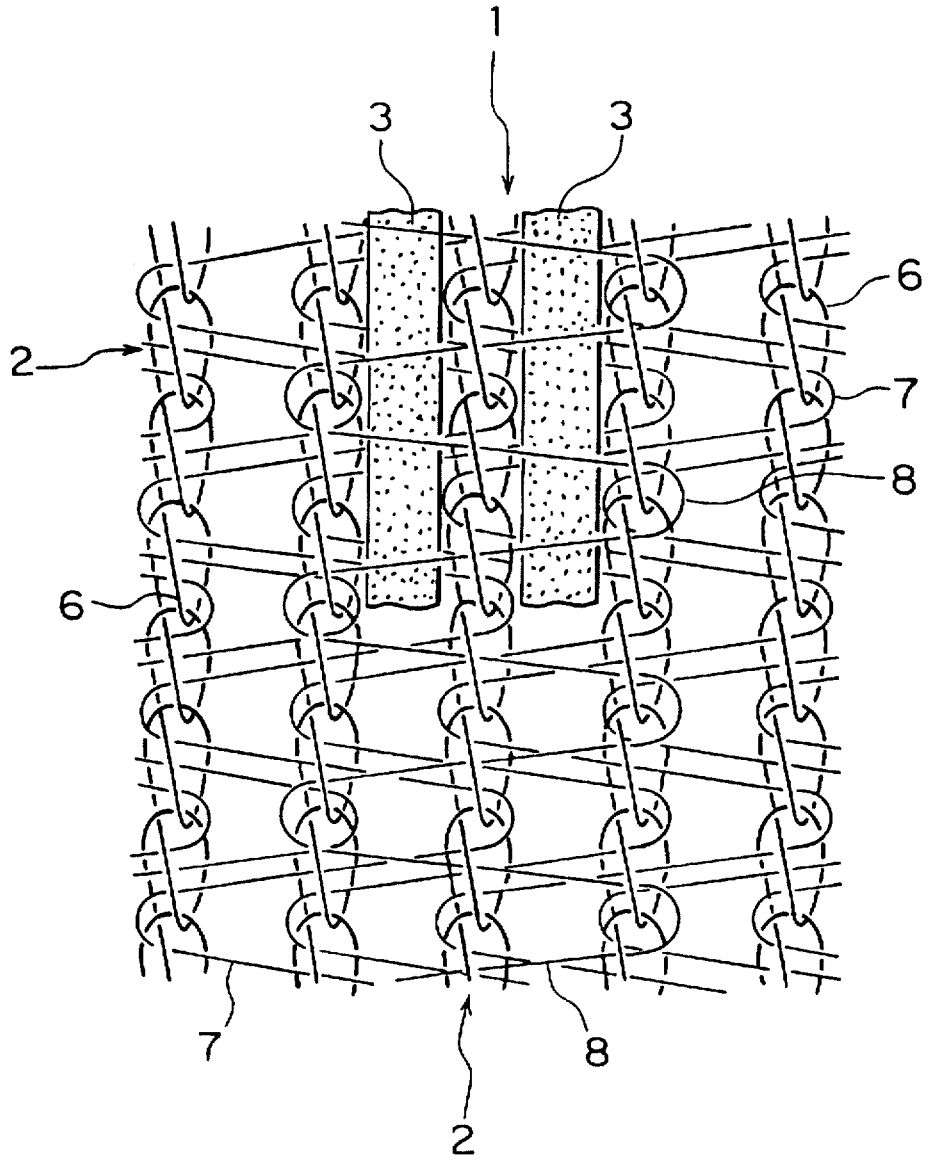
FIG. 2 is a fragmentary enlarged view of the reflective warp-knit tape in which reflective films are knitted.

Specifically, as shown in FIG. 2, the warp-knit tape 1 is knitted of chain-stitch yarns 6 having a knitting pattern of 0-1/0-1 and weft inlaid yarns 7 having an inlaying pattern of 0-0/3-3. The two reflective films 3 are disposed respectively in two interwale spaces between three central wales 2 and are held from the front side by additional weft inlaid yarns 8 having an inlaying pattern of 3-3/0-0. Thus each reflective film 3 is sandwiched between the first-named weft inlaid yarns (hereinafter also called the first weft inlaid yarns) 7 of 0-0/3-3 and the second-named weft inlaid yarns (hereinafter also called the second weft inlaid yarns) 8 of 3-3/0-0. The second weft inlaid yarns 8 are monofilament yarns of polyamide or polyester.

The reflective film 3 comprises a substrate layer of polyester resin, a reflective layer of metal, such as aluminum, silver and copper, formed on the substrate layer by evaporation, plating or painting, a glass-adhering layer of polyvinyl butyral resin formed on the substrate layer, and an uncountable number of glass beads adhered to the glass-adhering layer.

Figure 3:
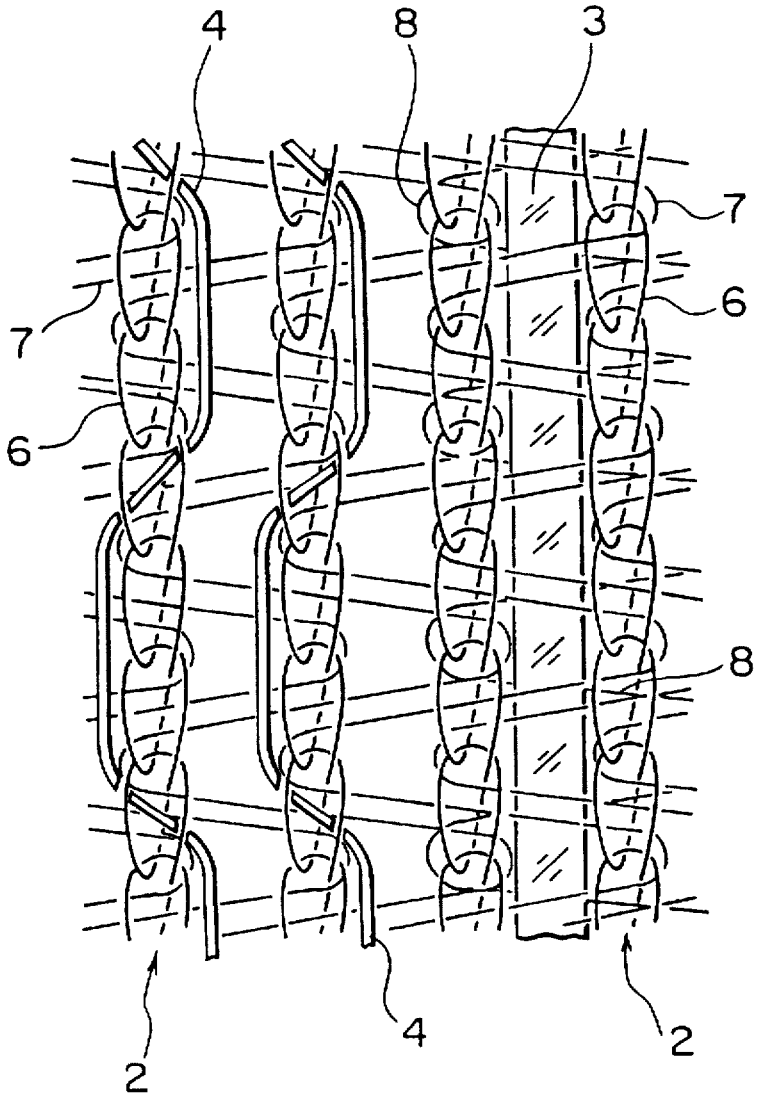
FIG. 3 is a fragmentary enlarged view of the reflective warp-knit tape in which the reflective film and heat-melting yarns are knitted.

FIG. 3 shows a modified reflective warp-knit tape according to a second embodiment of the invention. According to this modified reflective warp-knit tape, in a narrow-width warp-knit tape 1 knitted of chain-stitch yarns 6 of 0-1/0-1 and weft inlaid yarns 7 of 0-0/3-3 so as to form a number of longitudinal wales 2, two heat-melting yarns 4 of thermoplastic resin, e.g. each in the form of a polyethylene resin monofilament, having a melting point lower than that of the knitting yarns 6 are each inlaid in two wales 2 along each of opposite longitudinal margins in a pattern of 0-0/0-0/0-0/1-1/1-1/1-1 so that the narrow-width warp-knit tape 1 can be attached to a carrier product simply by welding under heat. This figure is viewed from the rear side, and the reflective film 3 may be knitted in the narrow-width warp-knit tape 1 as desired.

Figure 4:
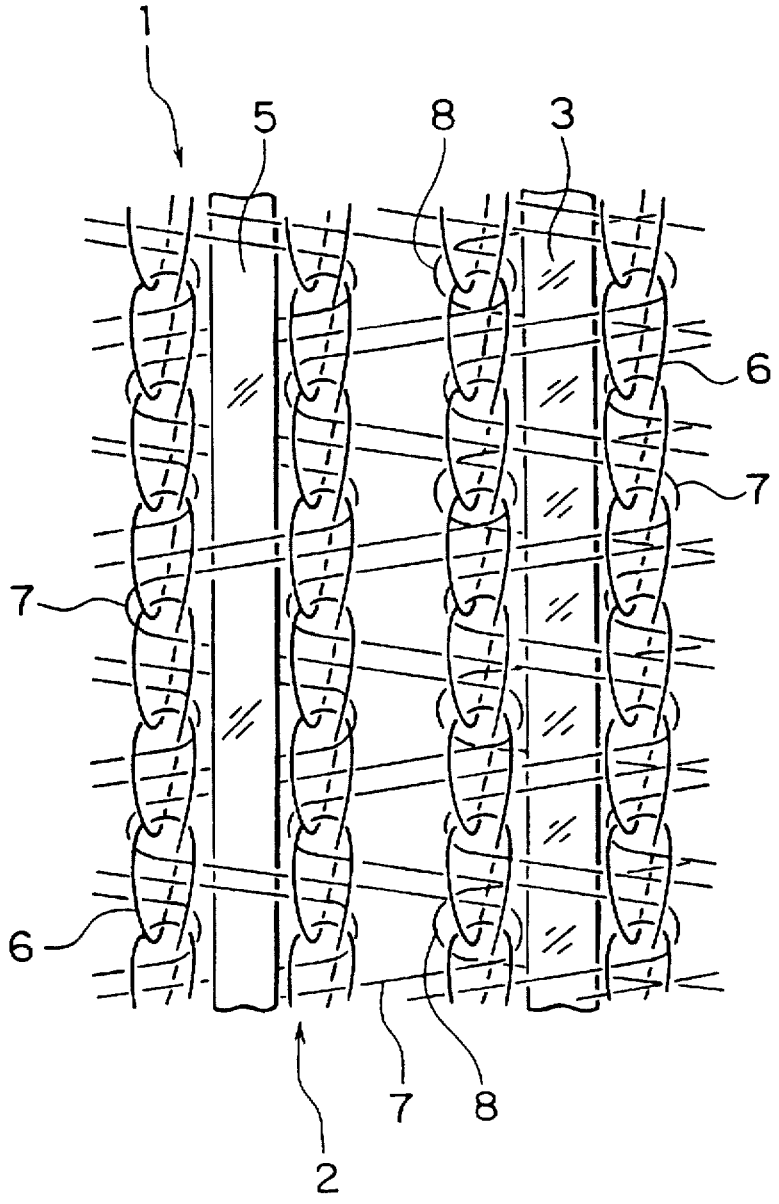
FIG. 4 is a fragmentary enlarged view of the reflective warp-knit tape in which the reflective films and heat-melting films are knitted.

In another modified reflective warp-knit tape according to this modified reflective warp-knit tape shown in FIG. 4, in a narrow-width warp-knit tape 1 knitted of chain-stitch yarns 6 of 0-1/0-1 and weft inlaid yarns 7 of 0-0/3-3, a heat-melting film 5 of thermoplastic resin, such as polyethylene, having a melting point lower than the knitting yarns of the narrow-width warp-knit tape 1 is knitted in and along a marginal interwale space so that the narrow-width warp-knit tape 1 can be attached to a carrier product simply by welding under heat.

Alternatively, the narrow-width warp-knit tape 1 may be knitted of two-needle-stitch yarns and weft inlaid yarns, or tricot-stitch yarns and weft inlaid yarns. Further, chain-stitch yarns may be added to this alternative warp-knit structure, which would however result in a slightly increased thickness.

In another alternative form, all the knitting yarns of the narrow-width warp-knit tape 1 may be transparent monofilament yarns of polyamide or polyester. Noting that the reflective film cannot be dyed, the narrow-width warp-knit tape 1 which is transparent through its entire area to match the carrier product, and in which the reflective film can reflect light with increased efficiency can be obtained.

Figure 5:
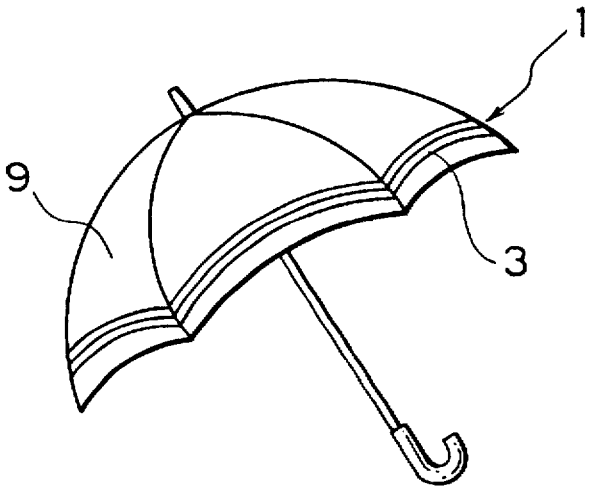
FIG. 5 is a side veiw of an umbrella, showing a manner that the reflective warp-knit tape is used.

For use as a traffic safety sign, the foregoing reflective warp-knit tape of this invention may be attached to the waist, sleeve or collar of a working uniform. Alternatively, the reflective warp-knit tape may be used on any other product; for example, it may be attached to the edge of an umbrella 9 as shown in FIG. 5. A reflective warp-knit tape of the invention may also be applied as a slide fastener tape.

With the reflective warp-knit tape of this invention, the following advantageous results can be obtained:

According to the reflective warp-knit tape of the first aspect of the invention, since the reflective film is knitted in the narrow-width warp-knit tape at a selected interwale space, it is possible to make the resulting tape adequately thin and flexible so as to match the shape of a carrier product, and also it is possible to make the reflective film visible very clearly through the interstices of the knit structure between the wales so that an excellent light-reflecting effect can be realized. Further, the reflective film is free from being removed off the tape even during severe use, thus expanding the range of applications of the reflective warp-knit tape.

According to the reflective warp-knit tape of the second aspect of the invention, partly since the narrow-width warp-knit tape is knitted with knitting yarns which form loops in wales and knitting yarns which run across wales, and partly since the reflective film is knitted in the narrow-width warp-knit tape at a selected interwale space so as to be held by the first and second weft inlaid yarns respectively extending over and under it, the warp-knit tape has a very simple warp-knit structure, and the reflective film can be knitted in easily.

According to the reflective warp-knit tape of the third aspect of the invention, since the narrow-width warp-knit tape is knitted of chain-stitch yarns and weft inlaid yarns, though the narrow-width warp-knit tape has a very simple warp-knit structure, it is possible to make the tape thinner than other conventional warp-knit structure, so that a quite flexible reflective warp-knit tape can be obtained.

According to the reflective warp-knit tape of the fourth aspect of the invention, since the heat-melting film is knitted in the narrow-width warp-knit tape at a selected interwale space along each of opposite longitudinal margins, it is possible to attach the tape to the carrier product very simply and easily by welding under heat, therefore the manner of use of the heat-melting film is ideal.

According to the reflective warp-knit tape of the fifth aspect of the invention, since the heat-melting yarns are knitted in the narrow-width warp-knit tape as the warp inlaid yarn at the wales along each of opposite longitudinal margins, it is possible to attach the tape to the carrier product very simply and easily by welding under heat, therefore the manner of use of the heat-melting yarn is ideal.

According to the reflective warp-knit tape of the sixth aspect of the invention, since the narrow-width warp-knit tape is knitted of transparent monofilament yarns of thermoplastic resin and is hence transparent through its entire area, it is possible to enable the reflective film to work reliably with increased efficiency. Further, since this reflective warp-knit tape is knitted using the transparent monofilament yarn, there is no need to select color of the knitting yarns so as to match the color of the article onto which the tape is attached, thus the advantageous results of the invention are remarkable.

What is claimed is:

1. A reflective warp-knit tape comprising:

(a) a narrow-width warp-knit tape having a plurality of longitudinal wales; and (b) a reflective film knitted in said narrow-width warp-knit tape at a selected interwale space.

2. A reflective warp-knit tape according to claim 1, wherein said warp-knit tape is knitted of a first set of knitting yarns forming loops in said wales, and a second set of knitting yarns extending between said wales across said reflective film, and interwale spaces where said reflective film are knitted in are knitted with knitting yarns extending over and under said reflective film.

3. A reflective warp-knit tape according to claim 1, wherein said narrow-width warp-knit tape is knitted of chain-stitch yarns and weft inlaid yarns.

4. A reflective warp-knit tape according to claim 1, further including a heat-melting film of thermoplastic resin having a melting point lower than that of said knitting yarns of said narrow-width warp-knit tape, said heat-melting film being knitted in said narrow-width warp-knit tape along at interwale space along each of opposite longitudinal margins.

5. A reflective warp-knit tape according to claim 1, further including a heat-melting monofilament yarn of thermoplastic resin having a melting point lower than that of said knitting yarns of said narrow-width warp-knit tape, said heat-melting yarn being knitted in said narrow-width warp-knit tape in the wales along each of opposite longitudinal margins.

6. A reflective warp-knit tape according to claim 1, wherein said knitting yarns of said narrow-width warp-knit tape are transparent thermoplastic resin monofilament yarns.

* * * * *